US005336847A

United States Patent [19]

Nakagami

[11] Patent Number: 5,336,847

[45] Date of Patent: Aug. 9, 1994

[54] STATIONARY INDUCTION APPARATUS CONTAINING UNINFLAMMABLE INSULATING LIQUID

[75] Inventor: Yoshitake Nakagami, Kawasaki, Japan

[73] Assignee: Fuji Electric Co., Ltd., Kawasaki, Japan

[21] Appl. No.: 876,483

[22] Filed: Apr. 30, 1992

[30] Foreign Application Priority Data

May 9, 1991 [JP] Japan ..... 3-102901
May 14, 1991 [JP] Japan ..... 3-107690

[51] Int. Cl.[5] ..... H01F 27/10

[52] U.S. Cl. ..... 174/17 LF; 174/15.1; 257/714; 336/57; 336/58; 336/94

[58] Field of Search ..... 174/15.1, 17 LF; 336/57, 58, 94; 252/573; 257/714, 715, 716

[56] References Cited

U.S. PATENT DOCUMENTS 3,629,758 12/1971 Pearce, Jr. ..... 336/57
4,394,635 7/1983 Foss ..... 336/57 X
4,485,367 11/1984 Hashizume ..... 336/57
4,556,511 12/1985 Nishigaki et al. ..... 336/58 X
4,565,901 1/1986 Hirooka et al. ..... 336/94 X
4,581,477 4/1986 Harumoto et al. ..... 174/15.1
4,812,262 3/1989 Shinzawa et al. ..... 336/94 X

FOREIGN PATENT DOCUMENTS 63-216206 9/1988 Japan .

*Primary Examiner*—Peter Dungra Vo
*Attorney, Agent, or Firm*—Allegretti & Witcoff, Ltd.

[57] ABSTRACT

An nonflammable insulating liquid is obtained by adding an emulsifying agent having a volume ratio of 1 to 3% to an insulating liquid containing a fluorocarbon liquid of at least 25% in a volume ratio to cause emulsification. In this liquid mixture, when polyol ester or dimethylcyloxane is used as the insulating liquid, an nonflammable insulating liquid that does not cause pollution or an environmental problem can be obtained. When tricresyl phosphate is used as the insulating liquid, an nonflammable insulating liquid having a dielectric constant close to that of insulating paper can be obtained. A liquid pipe for circulating a fluorocarbon emulsion in a tank is provided outside the tank, and a pump and a stirrer are connected midway along the liquid pipe to constantly stir the fluorocarbon emulsion, thereby preventing it from being separated into two layers. When a radiator is provided to the liquid pipe, the stirring system for the fluorocarbon emulsion can also serve as the cooling system.

3 Claims, 3 Drawing Sheets

STATIONARY INDUCTION APPARATUS CONTAINING UNINFLAMMABLE INSULATING LIQUID

BACKGROUND OF THE INVENTION

1. Field of the Invention

The present invention relates to an noninflammable insulating liquid and a stationary induction apparatus, e.g., a voltage transformer or a transformer using an noninflammable insulating liquid as a coolant.

2. Description of the Prior Art

A mineral oil-based insulating oil conventionally used widely as an insulating and cooling medium of an oil-sealed stationary induction apparatus is flammable. A strong demand has arisen for such an oil-sealed stationary induction apparatus to use an noninflammable insulating liquid in view of prevention against disasters. Polyclorinated biphenyl (PCB), which was put into practice for the first time as an noninflammable insulating liquid to replace the mineral oil-based insulating oil, was totally banned because of its accumulated toxicity. Hence, studies and developments have been made so far at various laboratories to develop a pollution-free noninflammable insulating liquid.

Noninflammable insulating liquids that can be currently actually used as the pollution-free insulating liquid and coolant are roughly classified into the fluorocarbon-, chloride-, ester-, and silicone oil-based uninflammable insulating liquids. An example of the fluorocarbon-based nonflammable insulating liquid includes, e.g., perfluorooctane ($C_8F_{18}$), perfluorocyclicether($C_8F_{16}O$), and perfluoropolyether. The fluorocarbonbased nonflammable insulating liquid is a completely uninflammable liquid which is chemically very stable and does not have a flash point or fire point. The chemical formula of perfluoropolyether is:

$$CF_3-[(O-\underset{\displaystyle CF_3}{\underset{|}{CF}}-CF_2)_n-(O-CF_2)_m]-O-CF_3$$

wherein m and n take various values to provide a multiple of types of perfluoropolyether having different boiling points and viscosities.

An example of the chloride-based uninflammable insulating liquid includes, e.g., a mixture (Japanese Patent Laid-Open No. 63-216206) obtained by mixing phosphate-based tricresyl phosphate $\{(CH_3C_6H_4O)3\text{-}.PO\}$ and perchloroethylene ($Cl_2C$: $CCl_2$) and a mixture (Japanese Patent Laid-Open No. 59-20909) obtained by mixing perchloroethylene and Freon. Although these chloride-based nonflammable insulating liquids were developed as products having no toxicity, as the great deal of attention has begun to be paid on environmental issues, it became difficult to put them into practical use. More specifically, limitation has begun to be put on products that can lead to destruction of the ozone layer, as is seen with Freon. Therefore, all the chloridebased products tend to be avoided.

As an ester-based nonflammable insulating liquid, e.g., polyol ester $\{C(CH_2)_4-(COOR)_4$ where R is an alkyl group$\}$ is commercially available as Midel-7131 (tradename) manufactured by Beck Blektroisolier-System Co. and sold by DAINICHISEIKA COLOUR & CHEMICALS MFG. CO., LTD. As a silicone oil-based nonflammable insulating liquid, e.g., dimethylcyloxane is commercially available. The ester- and silicone oil-based nonflammable insulating liquids are partly put into practical use as, e.g., a vehicle transformer since they do not pose pollution or an environmental problem. However, these liquids are said to be fire retardant and not completely nonflammable. More specifically, when compared to the mineral oil-based insulating oil, they merely have a very high flash point of several hundreds of °C. and do not catch fire easily. To have a flash point is a drawback, and development of a completely nonflammable liquid practically having no flash point is demanded. The fluorocarbon liquid described above is highly evaluated in terms of complete nonflammability.

The fluorocarbon liquid described above, however, has a large specific gravity and is very expensive.

The fluorocarbon-based liquid is partly put into practical use as it is completely, nonflammable, as described above, and is chemically inert. However, its specific gravity is twice that of the mineral oil-based insulating oil, and an electric instrument filled with the fluorocarbon liquid becomes very heavy. In addition, the cost of the fluorocarbon liquid per unit volume is higher than that of the mineral oil-based insulating oil by 100 times, resulting in an increase in weight of the overall electric instrument and cost. The fluorocarbon liquid is chemically inert. Accordingly, it can dissolve only a Freon-based material and a fluorocarbon-based material which is identical to itself. Hence, it is difficult to reduce the weight and cost by dissolving and mixing those materials in the fluorocarbon liquid.

SUMMARY OF THE INVENTION

It is an object of the present invention to provide an nonflammable insulating liquid which is lighter and has lower cost than liquid of a fluorocarbon liquid by forcibly mixing the fluorocarbon liquid and other insulating liquid by emulsification.

However, when such a fluorocarbon emulsion is used as a coolant of a stationary induction apparatus, fluorocarbon in the emulsion is separated from the insulating liquid due to a difference in specific gravity between them.

An emulsion state is a state in which liquid particles as colloidal particles of different liquids are co-present in a dispersed manner through an emulsifying agent. The different liquid particles are kept mixed for a considerably long period of time depending on the type of the emulsifying agent. However, if the specific gravities of the liquids are different, the heavier and lighter liquids are separated into the lower and upper layers, respectively. Therefore, in order to operate the stationary induction apparatus for a long period of time, the fluorocarbon emulsion need be constantly stirred.

It is another object of the present invention to prevent separation in the fluorocarbon emulsion by constantly circulating the fluorocarbon emulsion in a tank by a stirrer.

According to the present invention, there is provided an uninflammable insulating liquid obtained by adding an emulsifying agent of 1 to 3% in volume ratio in an emulsified condition to an insulating liquid containing a fluorocarbon liquid of at least 25% in volume ratio. In such an nonflammable insulating liquid, the insulating liquid is polyol ester, dimethylcyloxane, or tricresyl phosphate.

According to the present invention, an emulsifying agent of 1 to 3% in volume ratio is added to an insulating liquid containing a fluorocarbon liquid of at least 25% in volume ratio. When this liquid mixture is stirred to cause emulsification, it can be mixed with even a liquid which cannot conventionally be dissolved and mixed. The liquid mixture is completely nonflammable. Even if the insulating liquid only has fire retardancy, its fire retardancy is lost in the presence of the fluorocarbon liquid of at least 25% in volume ratio. If an insulating liquid having specific gravity and unit price lower than those of the fluorocarbon liquid is selected, those of the liquid mixture are naturally decreased.

In the liquid mixture described above, when polyol ester or dimethylcyloxane is used as the insulating liquid, an nonflammable insulating liquid which does not cause pollution, e.g., toxicity, or does not pose an environmental problem, e.g., ozone layer destruction, can be obtained.

In the liquid mixture described above, when tricresyl phosphate is used as the insulating liquid, an nonflammable insulating liquid having a dielectric constant closer to that of insulating paper can be obtained, and the breakdown voltage of a composite insulating structure with the insulating paper is considerably increased.

According to the present invention, there is provided a stationary induction apparatus comprising a tank for housing an nonflammable insulating liquid and a stationary induction apparatus, the nonflammable insulating liquid being obtained by adding an emulsifying agent to an insulating liquid containing a fluorocarbon liquid to cause emulsification, a pump, arranged outside the tank, for supplying the nonflammable insulating liquid, a first liquid pipe for supplying the nonflammable insulating liquid in the tank to a suction port of the pump, a second liquid pipe for supplying the nonflammable insulating liquid on a discharge on a discharge port of the pump to an inside of the tank, and a stirrer, connected midway or at an end of the first or second liquid pipe, for stirring the nonflammable insulating liquid. In this arrangement, a radiator is connected midway or at an end of the first or second liquid pipe. The stirrer is provided to midway or at the end of the first or second liquid pipe provided outside the tank, and the fluorocarbon emulsion serving as the nonflammable insulating liquid in the tank is circulated by the stirrer, so that the emulsion state is constantly maintained, and the fluorocarbon emulsion is prevented from being separated into two layers. In addition to this arrangement, when the radiator is connected midway or at the end of the first or second liquid pipe, the liquid pipe of the mixing system of the fluorocarbon emulsion can also serve as the pipe of the cooling system, leading to a cost reduction.

DETAILED DESCRIPTION OF THE PREFERRED EMBODIMENTS

Figure 1:
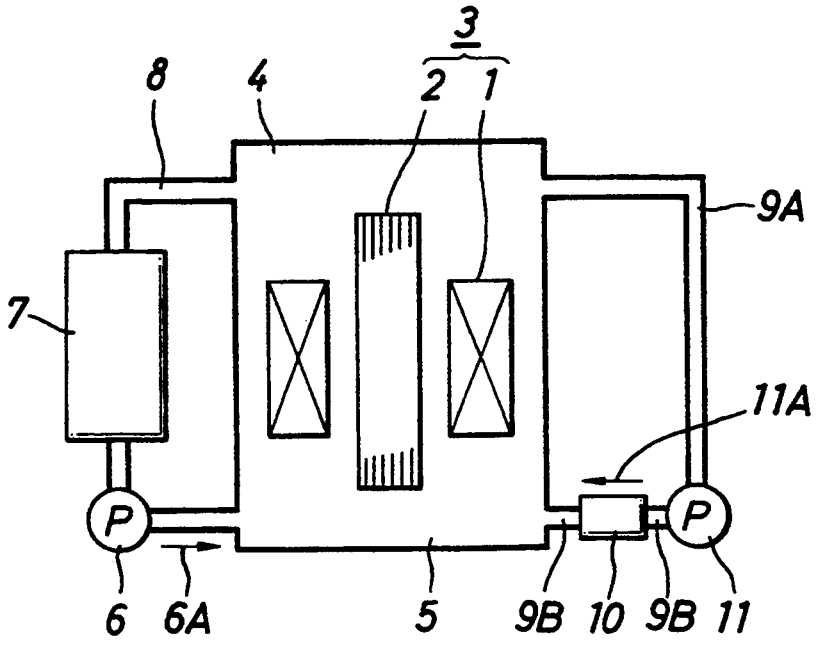
FIG. 1 is a sectional view of an arrangement of a stationary induction apparatus according to the first embodiment of the present invention.

The typical characteristics of the uninflammable insulating liquids according to the preferred embodiments of the present invention will be described by comparison with conventional nonflammable insulating liquids. The compositions of the nonflammable insulating liquids of Examples 1, 2, and 3 and Comparative Examples 1, 2, 3, and 4 are described as follows.

EXAMPLE 1

Stearic acid (C18H3602) as an emulsifying agent of 1% in a volume ratio and a derivative of perfluoropolyether (obtained by introducing a carboxyl group to the terminal of perfluoropolyether) having a volume ratio of 1% are added to a liquid mixture containing polyol ester as an insulating liquid of 50% in a volume ratio and perfluoropolyether as a fluorocarbon liquid of 50% in volume ratio to cause emulsification.

EXAMPLE 2

Stearic acid (C18H3602) as an emulsifying agent of 1% in volume ratio and a derivative of perfluoropolyether (obtained by introducing a hydroxyl group to the terminal of perfluoropolyether) of 1% in a volume ratio are added to a liquid mixture containing dimethylcyloxane as an insulating liquid having a volume ratio of 50% and perfluoropolyether as a fluorocarbon liquid of 50% in volume ratio to cause emulsification.

EXAMPLE 3

Stearic acid (C18H3602) as an emulsifying agent of 1% in volume ratio and a derivative of perfluoropolyether (obtained by introducing a carboxyl group to the terminal of perfluoropolyether) of 1% in volume ratio are added to a liquid mixture containing tricresyl phosphate as an insulating liquid of 50% in volume ratio and perfluoropolyether as a fluorocarbon liquid of 50% in volume ratio to cause emulsification.

COMPARATIVE EXAMPLE 1

Polyol ester.

COMPARATIVE EXAMPLE 2

Dimethylcyloxane

COMPARATIVE EXAMPLE 3

Tricresyl phosphate

COMPARATIVE EXAMPLE 4

Perfluoropolyether.

Regarding numbering of the above examples and comparative examples, products obtained by mixing perfluoropolyether to the products of Comparative Examples 1, 2, and 3 are numbered as Examples 1, 2, and 3, respectively. Perfluoropolyether used in above Examples 1, 2, and 3 and Comparative Example 4 has a boiling point of 200° C. and satisfies $m/n=20$ in the formula described above.

Mixing of an insulating liquid with a fluorocarbon liquid was conventionally regarded to be impossible. However, it was found by the present inventors that such mixing was possible by adding an emulsifying agent to cause emulsification, as in Examples 1, 2, and 3. When an insulating liquid is merely mixed to the fluorocarbon liquid, the mixture is separated into upper and lower layers because of the difference in specific gravity of the two materials. However, when an emulsifying agent is added to the liquid mixture and the mixture is stirred, emulsification takes place and the liquids of the two materials are uniformly dispersed in the form of colloidal particles (having a particle size of about 0.1 to 1 μm). To emulsify the fluorocarbon liquid by adding an emulsifying agent is itself a known technique. However, to mix another insulating liquid, in addition to the emulsifying agent, to the fluorocarbon liquid, thereby setting the insulating liquid nonflammable, is a novel technique.

Table 1 indicates experimental data obtained with respect to the examples and comparative examples described above.

TABLE 1

| | Examples | | | Comparative Examples | | | |
|---|---|---|---|---|---|---|---|
| | 1 | 2 | 3 | 1 | 2 | 3 | 4 |
| Fire Point (°C.) | None | None | None | 305 | 360 | None | None |
| Flash Point (° C.) | None | None | None | 280 | 300 | 272 | None |
| Boiling Point (°C.) | 210< | 210< | 210< | 400< | 500< | 420 | 200 |
| Specific Gravity | 1.39 | 1.38 | 1.48 | 0.98 | 0.96 | 1.17 | 1.79 |
| Dielectric Constant | 2.7 | 2.3 | 4.1 | 3.2 | 2.7 | 6.4 | 2.1 |

The fire point, flash point, boiling point, specific gravity, and dielectric constant of the respective examples of Table 1 were measured. The fire point and flash point were measured in accordance with JIS K2274-1962. A flash point is a lowest temperature at which the vapor of the liquid sample catches fire, and a fire point is an initial temperature at which the liquid sample starts burning that lasts for at least 5 seconds when the temperature of the liquid sample is raised higher than the flash point.

Referring to Table 1, Examples 1, 2, and 3 have neither a flash point nor a fire point. In each of Examples 1, 2, and 3, an insulating liquid which originally has a flash or fire point of several hundreds of °C. is completely set to be nonflammable by mixing the fluorocarbon liquid and by emulsification. The boiling points of Examples 1, 2, and 3 are not lower than that of Comparative Example 4. If the boiling point of the liquid is excessively low, the liquid is gasified at an operation temperature of the electric instrument. Hence, the boiling point is a important factor in practice.

The specific gravities of Examples 1, 2, and 3 are about 1.4, which is smaller than that of Comparative Example 4. This is because each of the specific gravities of Comparative Examples 1, 2, and 3 is about 1.0, which is smaller than that of Comparative Example 4. The weight of a heavy fluorocarbon liquid can be decreased by emulsification.

In Example 3, the dielectric constant is about tiwice that of Example 1 or 2. This is because Comparative Example 3 has a large dielectric constant of 6.4. When an nonflammable insulating liquid has a large dielectric constant of 6.4, its dielectric breakdown voltage in a composite insulating structure with insulating paper is increased, which is very advantageous. That is, since the insulating paper has a dielectric constant of about 4.0, when a high voltage is applied to the composite insulating structure, the electric field is uniformly applied on both the insulating paper and the nonflammable insulating liquid. Conventionally, when a liquid having a smaller dielectric constant than that of the insulating paper is used, like the fluorocarbon liquid of Comparative Example 4, a high electric field is applied on the insulating liquid upon application of a high voltage to a composite insulating structure with the insulating paper, and the insulating liquid having a lower threshold voltage than the insulating paper causes dielectric breakdown earlier than the insulating paper. This drawback is solved in Example 3.

In the examples in Table 1, the fluorocarbon liquid has a volume ratio of 50%. However, even if this volume ratio is decreased down to 25%, even a inflammable insulating liquid can be set nonflammable by mixing this fluorocarbon liquid and emulsification. Note that a future nonflammable insulating liquid will not generally be allowed if it causes pollution or poses an environmental problem. The samples of Examples 1, 2, and 3 provide nonflammable insulating liquids which pose no problem in this respect.

FIG. 1 is a sectional view of an arrangement of a stationary induction apparatus according to the first embodiment of the present invention. A static induction apparatus body 3 comprising a wiring 1 and a core 2 is housed in a tank 4. A fluorocarbon emulsion 5 is filled in the tank 4. A radiator 7 and a pump 6 are connected to the tank 4 through a pipe 8. A pump 11 is connected between first and second liquid pipes 9A and 9B. A stirrer 10 is connected midway along the second liquid pipe 9B. The fluorocarbon emulsion 5 is supplied in the direction of an arrow of a liquid flow 6A and cooled by the radiator 7. Meanwhile, the fluorocarbon emulsion 5 is supplied in the direction of an arrow of a liquid flow 11A by the pump 11, and stirred by the stirrer 10, thereby preventing the fluorocarbon emulsion 5 from being separated into two layers.

Figure 2:
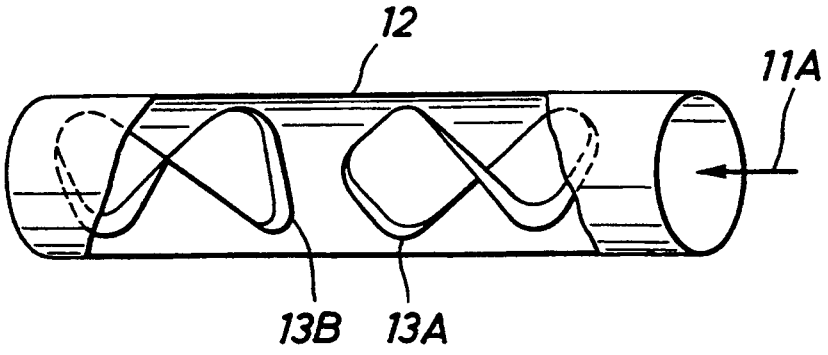
FIG. 2 is a partially cutaway perspective view showing an arrangement of the main part of a stirrer shown in FIG. 1.

FIG. 2 is a partially cutaway perspective view showing an arrangement of the main part of the stirrer 10 of FIG. 1. A front part of a cylindrical pipe 12 connected midway along the second liquid pipe 9B of FIG. 1 is partially cut out to show torsion blades 13A and 13B inside it. The torsion blades 13A and 13B are fixed on the inner wall of the round tube 12 through a support (not shown) so that they will not rotate. The right and left ends of each blade are twisted from each other by 180° and the torsion blades 13A and 13B are disposed such that the directions of their opposite blades are shifted from each other by 90°. When the liquid flow 11A of the fluorocarbon emulsion 5 flows into the cylindrical pipe 12 from the right end of FIG. 2, the fluorocarbon emulsion 5 flows toward the outlet on the left end of the cylindrical pipe 12 while it is stirred by the torsion blades 13A and 13B. FIG. 2 shows a socalled stationary type tube stirrer (or a static mixer) which is commercially available. A static mixer having a larger number of torsion blades than that of the arrangement of FIG. 2 is also available to stir the fluorocarbon emulsion more uniformly.

Figure 3:
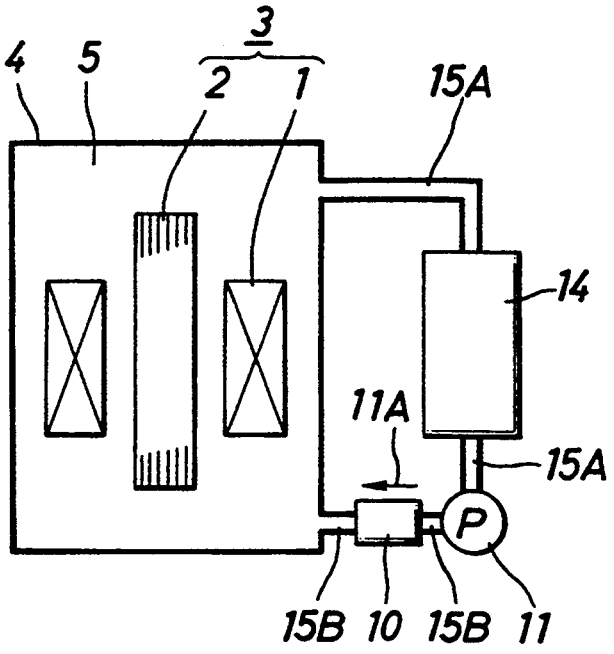
FIG. 3 is a sectional view of an arrangement of a stationary induction apparatus according to the second embodiment of the present invention.

FIG. 3 is a sectional view of an arrangement of a stationary induction apparatus according to the second embodiment of the present invention. A stationary induction apparatus body 3 comprising a wiring 2 and a core 2 is housed in a tank 4. A fluorocarbon emulsion 5 is filled in the tank 4. A pump 11 and a radiator 14 are connected between first and second liquid pipes 15A and 15B, and a stirrer 10 having the arrangement shown in FIG. 2 is connected midway along the second liquid pipe 15B. The fluorocarbon emulsion 5 is supplied in the direction of an arrow of a flow path 11A by the pump 11 and cooled by the radiator 14. The fluorocarbon emulsion 5 is stirred by the stirrer 10 to prevent it from separating into two layers.

The arrangement of FIG. 3 is different from that of FIG. 1 in that cooling and stirring of the fluorocarbon emulsion 5 are enabled by circulation in one pipe system. If forced oil supply cooling is employed, the liquid supply pump can also be used for this purpose.

Figure 4:
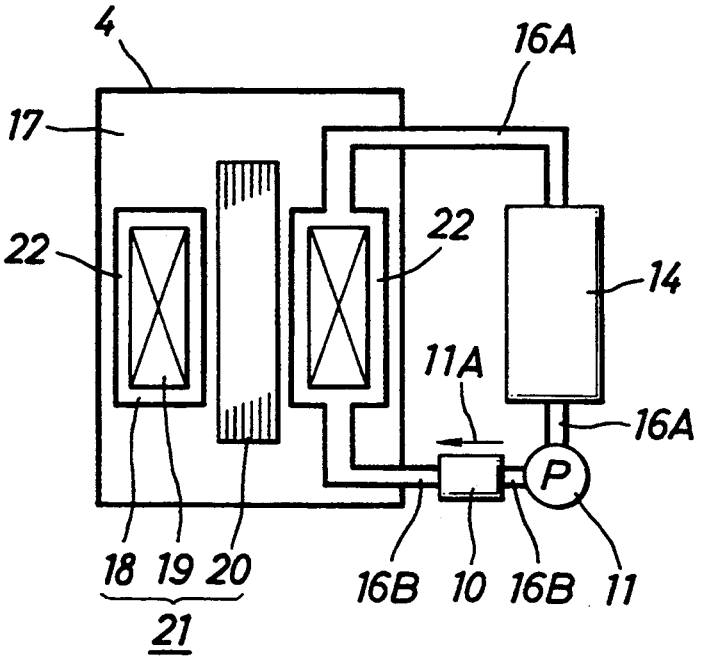
FIG. 4 is a sectional view of an arrangement of a stationary induction apparatus according to the third embodiment of the present invention.

FIG. 4 is a sectional view of an arrangement of a static induction apparatus according to the third embodiment of the present invention. A static induction apparatus body 21 comprises a core 20 and a wiring 19 housed in an insulating tank 18 and wound on the core 20, and is housed in a tank 4. A fluorocarbon emulsion 22 is sealed in the insulating tank 18, and an $SF_6$ gas 17 is filled in the tank 4 outside the insulating tank 18. First and second liquid pipes 16A and 16B are connected to communicate with the interior of the insulating tank 18 and are connected to a radiator 14, a pump 11, and a stirrer 10 outside the tank 4.

The arrangement of FIG. 4 is different from that of FIG. 3 in that the tank 4 seals the $SF_6$ gas 17 therein and that the insulating tank 18 separates the $SF_6$ gas 17 and the fluorocarbon emulsion 22 from each other. The fluorocarbon emulsion 22 is supplied in the direction of an arrow of a liquid flow 11A by the pump 11 to effectively cool only the wiring 19 serving as the heater and to prevent itself from separating into two layers.

The arrangement of FIG. 4 is conventionally referred to as a separate type. According to this arrangement, the quantity of the expensive fluorocarbon liquid (it currently costs 100 times a mineral oil) whose specific gravity is large (about twice that of the mineral oil), is minimized, and the dielectric strength of the SF6 gas 17 is used to insulate the tank 4. The fluorocarbon emulsion 22 is used in place of the fluorocarbon liquid, and the heat of the wiring 19 is discharged by the radiator 14 by stirring the liquid 22 by the stirrer 10. With this arrangement, the cost of the coolant of the wiring 19 can be further decreased, and the weight of the coolant can be decreased.

Figure 5:
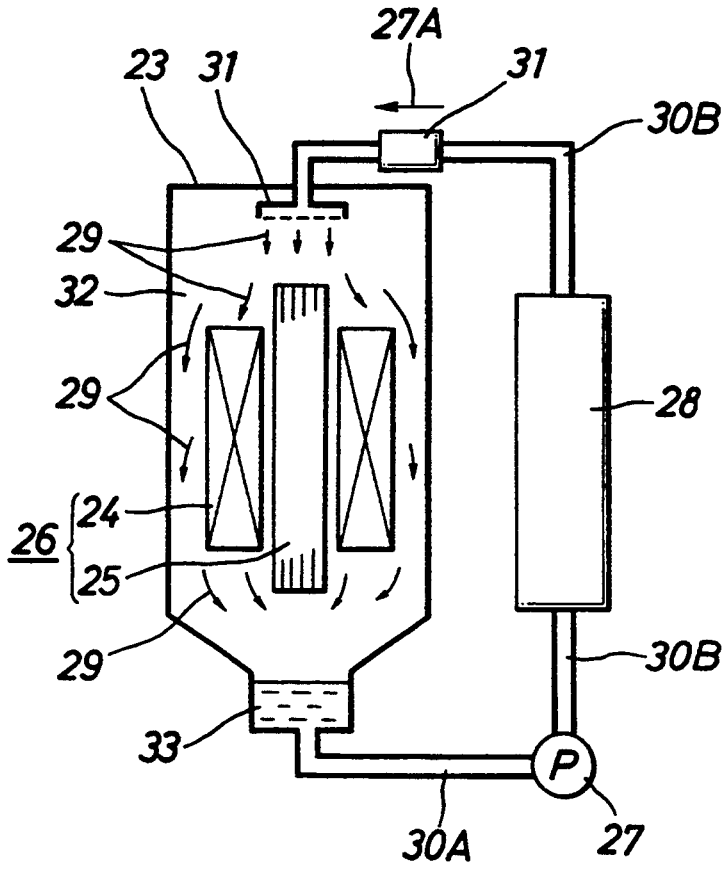
FIG. 5 is a sectional view of an arrangement of a stationary induction apparatus according to the fourth embodiment of the present invention.

FIG. 5 is a sectional view of an arrangement of a stationary induction apparatus according to the fourth embodiment of the present invention. A stationary induction apparatus body 26 comprises a wiring 24 and a core 25 and is housed in a tank 23. A pump 27, a radiator 28, and a stirrer 31 having the arrangement shown in FIG. 2 are connected to first and second liquid pipes 30A and 30B communicating with tank 23. A spreader 32 (having a multiple of through holes formed in its lower surface) for spreading the fluorocarbon emulsion 29 is provided in the tank 23 on the side of the second liquid pipe 30B. One end of the first liquid pipe 30A extends to the bottom portion of the tank 23 and to be connected to the lower portion of a liquid reservoir 33 for temporarily storing the fluorocarbon emulsion 29.

Referring to FIG. 5, the pump 29 supplies the fluorocarbon emulsion 29 in the direction of an arrow of a liquid flow 27A. The spreader 31 spreads the fluorocarbon emulsion 29 in the form of the droplets in the stationary induction apparatus body 26. After the fluorocarbon emulsion 29 cools the wiring 24 serving as the heater while dropping, it is stored in the liquid reservoir 33 at the lower portion of the tank 23. The fluorocarbon emulsion 29 in the liquid reservoir 33 is drawn by the pump 27 by vacuum and its heat is radiated by the radiator 28. Simultaneously, the fluorocarbon emulsion 29 is prevented from being separated into two layers by the stirrer 31.

The arrangement of FIG. 5 is conventionally referred to as an evaporation cooling type. According to this arrangement, the quantity of the expensive fluorocarbon liquid is minimized, and the wiring 24 is effectively cooled by the evaporation latent heat of the fluorocarbon liquid. Although the fluorocarbon liquid is partly evaporated temporarily by the heat of the wiring 24 while it drops, it is cooled by the surrounding tank 23 to be liquefied and is stored in the liquid reservoir 33. When the fluorocarbon emulsion 29 is used in place of the conventional fluorocarbon liquid, the wiring 24 can be cooled completely in the same manner as in the conventional method. According to this embodiment, the unit price of the coolant of the wiring 24 can be further decreased, and the weight of the coolant can be decreased.

All the stirrers of FIGS. 1, 2, 3, 4, and 5 are of the static type shown in FIG. 2. However, other than the static type, a rotating blade-type stirrer, an ultrasonic vibration-type stirrer, or a colloid mill utilizing the centrifugal force can be employed. The arrangement of FIG. 1 employs forced oil supply comprising the pump 6 and the radiator 7. However, even if the pump 6 and the radiator 7 are omitted in FIG. 1 (to provide an arrangement for a self-cooling or meter transformer), separation of the fluorocarbon emulsion 5 can be prevented by providing the pump 11 and the stirrer 10 on the right side.

What is claimed is:

1. A stationary induction apparatus comprising a tank containing an uninflammable insulating liquid therein and a stationary induction body, said uninflammable insulating liquid consisting of an insulating liquid containing a fluorocarbon liquid and an emulsifying agent which is added to said insulating liquid to render the fluorocarbon liquid and the insulating liquid together in an emulsified condition when stirred; a pump arranged outside said tank for supplying the uninflammable insulating liquid; a first liquid pipe for supplying said uninflammable insulating liquid to said tank, said first liquid pipe connected to a suction port of said pump; a second liquid pipe for supplying said uninflammable insulting liquid to a discharge port of said pump and thereafter to the inside of said tank; and a separate stirrer disposed on said first or second liquid pipe, for stirring said uninflammable insulating liquid.

2. A stationary induction apparatus comprising a tank containing an uninflammable insulating liquid therein and a stationary induction body said uninflammable insulating liquid consisting of an insulating liquid containing a fluorocarbon liquid and an emulsifying agent which is added to said insulating liquid to render the fluorocarbon liquid and the insulating liquid together in an emulsified condition when stirred; said uninflammable insulating liquid comprising an insulating liquid which contains a fluorocarbon liquid of at least 25% in volume ratio and an emulsifying agent of 1 to 3% in volume ratio added to said insulating liquid in an emulsified condition; a pump arranged outside said tank for supplying the uninflammable insulating liquid; a first liquid pipe for supplying said uninflammable insulating liquid to said tank, said first liquid pipe connected to a suction port of said pump; a second liquid pipe for supplying said uninflammable insulating liquid to a discharge port of said pump and thereafter to the inside of said tank; and a separate stirrer disposed on said first or second liquid pipe, for stirring said uninflammable insulating liquid.

3. The apparatus according to claim 1 wherein a radiator is connected to said first or second liquid pipe.

* * * * *